US011548064B2

(12) United States Patent
Cheon

(10) Patent No.: US 11,548,064 B2
(45) Date of Patent: Jan. 10, 2023

(54) CASTING APPARATUS AND CASTING METHOD

(71) Applicants: HYUNDAI MOTOR COMPANY, Seoul (KR); KIA CORPORATION, Seoul (KR)

(72) Inventor: Moo Hyuck Cheon, Gyeongju-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/486,306

(22) Filed: Sep. 27, 2021

(65) Prior Publication Data

US 2022/0008988 A1 Jan. 13, 2022

Related U.S. Application Data

(62) Division of application No. 17/012,571, filed on Sep. 4, 2020, now Pat. No. 11,161,173.

(30) Foreign Application Priority Data

Mar. 5, 2020 (KR) ..... 10-2020-0027955

(51) Int. Cl.
*B22D 17/24* (2006.01)
*B22D 17/22* (2006.01)

(52) U.S. Cl.
CPC ..... *B22D 17/24* (2013.01); *B22D 17/2263* (2013.01)

(58) Field of Classification Search
CPC ..... B22D 17/24; B22D 17/2263
See application file for complete search history.

(56) References Cited

U.S. PATENT DOCUMENTS

2003/0155096 A1 8/2003 Niimi et al.
2004/0099397 A1 5/2004 Sasaoka et al.
2018/0221945 A1 8/2018 Masuzawa et al.

*Primary Examiner* — Kevin P Kerns
*Assistant Examiner* — Steven S Ha
(74) *Attorney, Agent, or Firm* — McDonnell Boehnen Hulbert & Berghoff LLP

(57) ABSTRACT

The present disclosure relates to a casting apparatus including a support block, a die provided on one surface of the support block and configured to form a cavity in cooperation with the support block, and an insert member provided to be movable relative to the support block and configured to selectively move between a first position at which the insert member is received in the cavity and a second position at which the insert member is extracted out of the cavity, thereby obtaining an advantageous effect of simplifying a structure and a manufacturing process.

2 Claims, 5 Drawing Sheets

CASTING APPARATUS AND CASTING METHOD

CROSS REFERENCE TO RELATED APPLICATIONS

The present application is a divisional of U.S. patent application Ser. No. 17/012,571, filed Sep. 4, 2020, which claims priority to and the benefit of Korean Patent Application No. 10-2020-0027955 filed in the Korean Intellectual Property Office on Mar. 5, 2020, the entire contents of which are incorporated herein by reference.

TECHNICAL FIELD

The present disclosure relates to a casting apparatus and a casting method, and more particularly, to a casting apparatus and a casting method, which are capable of simplifying a structure and a manufacturing process.

BACKGROUND

Squeeze casting refers to a method of forming a product by mechanically applying a high pressure to melted or semi-melted metal injected into a mold until the melted or semi-melted metal is completely solidified. The squeeze casting is also called molten metal forging or forging casting because the squeeze casting directly presses and molds the molten metal.

Die casting is an example of the squeeze casting and refers to precise casting that obtains a casting equal in shape to a steel mold by injecting molten metal into the mold accurately machined to have a shape perfectly equal to a required shape of the casting.

A manufacturing method using the die casting is widely used because of characteristics in which mechanical properties are excellent and mass production is possible in addition to an advantage in that it is possible to implement a casting having an accurate dimension such that the casting need not be finished.

Meanwhile, in forming a product with the squeeze casting (e.g., die casting), a molded body, which has been completely manufactured in a mold, needs to be stably ejected (separated) from the mold.

However, in the related art, in order to eject a molded body that has been completely manufactured in a mold, several tens of (e.g., 20 to 70) ejector pins need to be used to push and separate the molded body attached to an insert fixed to the mold, and various types of additional devices such as an ejector plate and a base for supporting the ejector pins need to be also provided, which causes a problem in that an overall structure of a casting apparatus is complicated and the facility costs are increased.

In addition, in the related art, the ejector pin and the mold are frequently damaged and broken during a process of pushing the molded body from the mold by using the ejector pin, which causes a problem in that maintenance and repair costs are increased. Further, a production process needs to be inevitably stopped in order to repair and replace the ejector pin and the mold, which causes both production efficiency and productivity to deteriorate.

Therefore, recently, various studies are conducted to simplify a structure and a process for ejecting a molded body from a mold, but the study result is still insufficient. Accordingly, there is a need for development of a technology for simplifying a structure and a process for ejecting a molded body from a mold.

SUMMARY

An object of the present disclosure is to provide a casting apparatus and a casting method which are capable of simplifying a structure and a manufacturing process.

Another object of the present disclosure is to eject a molded body from a die without using an ejector pin.

Still another object of the present disclosure is to reduce manufacturing costs and decrease maintenance and repair costs.

Yet another object of the present disclosure is to reduce the time taken to manufacture a molded body and improve production efficiency.

The object to be achieved by the exemplary embodiment is not limited to the above-mentioned objects, but also includes objects or effects that may be recognized from the solutions or the exemplary embodiments described below.

According to the exemplary embodiment of the present disclosure provided to achieve the above-mentioned objects of the present disclosure, a casting apparatus includes a support block, a die provided on one surface of the support block and configured to form a cavity in cooperation with the support block, and an insert member provided to be movable relative to the support block and configured to selectively move between a first position at which the insert member is received in the cavity and a second position at which the insert member is extracted out of the cavity.

One object of the disclosure is to simplify a structure and a manufacturing process of the casting apparatus.

According to the exemplary embodiment of the present disclosure, no separate ejector pin is used to eject the molded body from the die, and the insert member is separated from the molded body by being moved relative to the molded body (e.g., by being moved rearward away from the molded body), such that it is possible to obtain an advantageous effect of simplifying a structure and a manufacturing process, reducing maintenance and repair costs, and improving production efficiency.

The die may be variously changed in shape and structure in accordance with required conditions and design specifications.

As an example, the die may include a first mold that defines one part of a wall surface of the cavity, and a second mold that defines the other part of the wall surface of the cavity.

In particular, the first mold and the second mold are provided such that at least one of the first mold and the second mold may move toward and away from the other of the first mold and the second mold.

According to the exemplary embodiment of the present disclosure, a through hole may be formed in the support block, and the insert member may move from the first position to the second position along the through hole.

In particular, when the insert member moves from the first position to the second position, the molded body formed in the cavity may be supported by the support block, and the insert member may be separated from the molded body.

According to the exemplary embodiment of the present disclosure, the casting apparatus may include a restriction unit that selectively restricts the insert member disposed at the first position.

Since the restriction unit is provided to selectively restrict the insert member disposed at the first position as described above, it is possible to prevent the insert member from being pushed rearward by pressure of the molten metal injected into the cavity, and as a result, it is possible to obtain an advantageous effect of improving stability and reliability and more precisely manufacturing the molded body.

The restriction unit may have various structures capable of restricting the insert member disposed at the first position.

As an example, the restriction unit may include a first restriction block provided on the other surface of the support block and configured to move between a first closed position at which the first restriction block closes the through hole and a first opened position at which the first restriction block opens the through hole, and a second restriction block provided on the other surface of the support block and configured to move between a second closed position at which the second restriction block closes the through hole and a second opened position at which the second restriction block opens the through hole.

According to the exemplary embodiment of the present disclosure, the casting apparatus may include a holder member configured to support the first restriction block and the second restriction block such that the first restriction block and the second restriction block are movable.

Since the holder member is provided as described above, the movements and the arrangement states of the first restriction block and the second restriction block relative to the support block may be stably supported, such that it is possible to obtain an advantageous effect of more stably maintaining the arrangement state of the insert member and more precisely manufacturing the molded body.

According to the exemplary embodiment of the present disclosure, the casting apparatus may include a transfer unit configured to transfer the molded body formed in the cavity. When the mold and the insert member are separated from the molded body in a state in which the transfer unit holds the molded body, the transfer unit may transfer the molded body to a predetermined ejected position.

According to another aspect of the present disclosure, a casting method may include disposing an insert member in a cavity provided in a die, forming a molded body by injecting molten metal into the cavity, separating the die from the molded body, separating the insert member from the molded body by moving the insert member out of the cavity, and transferring the molded body to a predetermined ejected position.

According to the exemplary embodiment of the present disclosure, the die may be provided on one surface of a support block and may form the cavity in cooperation with the support block, and in the separating of the insert member from the molded body by moving the insert member out of the cavity, the molded body may be supported by the support block, and the insert member may be moved and separated from the molded body.

DETAILED DESCRIPTION

Figure 1:
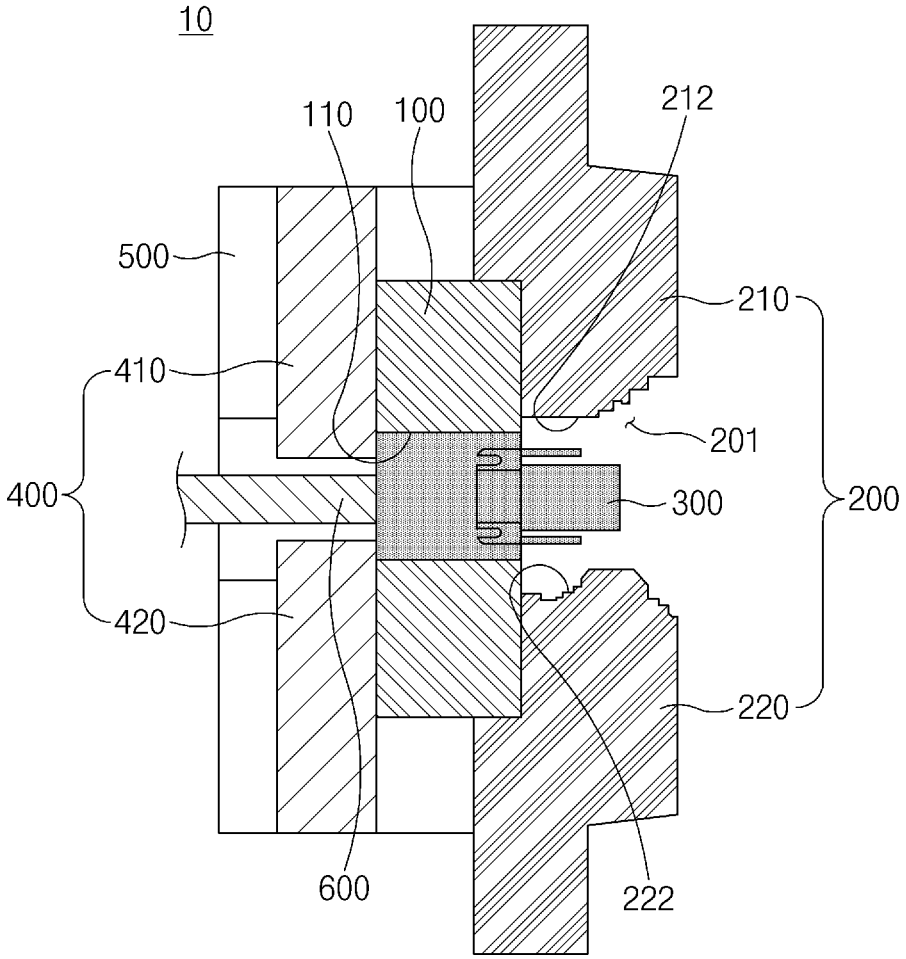
FIG. 1 shows a casting apparatus according to the present disclosure.

Hereinafter, exemplary embodiments of the present disclosure will be described in detail with reference to the accompanying drawings.

However, the technical spirit of the present disclosure is not limited to some exemplary embodiments described herein but may be implemented in various different forms. One or more of the constituent elements in the exemplary embodiments may be selectively combined and substituted within the scope of the technical spirit of the present disclosure.

In addition, unless otherwise specifically and explicitly defined and stated, the terms (including technical and scientific terms) used in the exemplary embodiments of the present disclosure may be construed as the meaning which may be commonly understood by the person with ordinary skill in the art to which the present disclosure pertains. The meanings of the commonly used terms such as the terms defined in dictionaries may be interpreted in consideration of the contextual meanings of the related technology.

In addition, the terms used in the exemplary embodiment of the present disclosure are for explaining the exemplary embodiments, not for limiting the present disclosure.

Unless particularly stated otherwise in the context of the present specification, a singular form may also include a plural form. The explanation "at least one (or one or more) of A, B, and C" described herein may include one or more of all combinations that can be made by combining A, B, and C.

In addition, the terms such as first, second, A, B, (a), and (b) may be used to describe constituent elements of the exemplary embodiments of the present disclosure.

These terms are used only for the purpose of discriminating one constituent element from another constituent element, and the nature, the sequences, or the orders of the constituent elements are not limited by the terms.

Further, when one constituent element is described as being 'connected', 'coupled', or 'attached' to another constituent element, one constituent element can be connected, coupled, or attached directly to another constituent element or connected, coupled, or attached to another constituent element through still another constituent element interposed therebetween.

In addition, the explanation "one constituent element is formed or disposed above (on) or below (under) another constituent element" includes not only a case in which the two constituent elements are in direct contact with each other, but also a case in which one or more additional constituent elements are formed or disposed between the two constituent elements. In addition, the expression "up (above) or down (below)" may include a meaning of a downward direction as well as an upward direction based on one constituent element.

Referring to FIGS. 1 to 5, a casting apparatus 10 according to the present disclosure includes a support block 100, a die 200 provided on one surface of the support block 100 and configured to form a cavity 201 in cooperation with the support block 100, and an insert member 300 movable relative to the support block 100 and configured to selectively move between a first position at which the insert member 300 is received in the cavity 201 and a second position at which the insert member 300 is extracted out of the cavity 201.

For reference, the casting apparatus 10 according to the present disclosure may be used to form a molded body M (shown in FIGS. 2-5) by casting (e.g., die casting), and the present disclosure is not restricted or limited by the type and the structure of the molded body M. As an example, the casting apparatus according to the present disclosure may be used to manufacture vehicle components such as a cylinder block.

The support block 100 forms, in cooperation with the die 200, the cavity 201 corresponding to the molded body M.

The support block 100 may be variously changed in shape and structure in accordance with required conditions and design specifications, and the present disclosure is not restricted or limited by the shape and the structure of the support block 100.

As an example, the support block 100 may be formed as an approximately quadrangular block, and one surface (e.g., a right surface based on FIG. 1) of the support block 100 may define a bottom surface of the cavity 201.

The die 200 is provided on one surface of the support block 100 and configured to form the cavity 201 in cooperation with the support block 100.

The cavity 201 having a shape and a structure corresponding to those of the molded body M is formed in the die 200.

The die 200 having the cavity 201 may be variously changed in shape and structure in accordance with required conditions and design specifications, and the present disclosure is not restricted or limited by the structure and the shape of the die 200.

As an example, the die 200 may include a first mold 210 that defines one part of a wall surface of the cavity 201, and a second mold 220 that defines the other part of the wall surface of the cavity 201. The first mold 210 and the second mold 220 may form the cavity 201 in cooperation with the support block 100.

More specifically, an inner surface 212 of the first mold 210 may define one part of a side wall surface of the cavity 201, and an inner surface 222 of the second mold 220 may define the other part of the side wall surface of the cavity 201. The right surface of the support block 100 may define the bottom surface of the cavity 201.

In the exemplary embodiment of the present disclosure, the configuration in which the die 200 includes the two molds (the first mold and the second mold) is described as an example, but according to another exemplary embodiment of the present disclosure, the die may include three or more molds, and the present disclosure is not restricted or limited by the number of molds and the arrangement structure of the molds that constitute the die.

For reference, molten metal for forming the molded body M is injected into the cavity 201 formed in the die 200.

Various types of metal or alloys may be used as the molten metal in accordance with the required conditions and the design specifications, and the present disclosure is not restricted or limited by the type and the property of the molten metal. As an example, an alloy made of zinc, aluminum, tin, copper, magnesium, or the like may be used as the molten metal.

In particular, the first mold 210 and the second mold 220 are provided such that at least one of the first mold 210 and the second mold 220 may move toward and away from the other of the first mold 210 and the second mold 220.

As an example, the first mold 210 may be provided to be movable in directions in which the first mold 210 moves toward and away from the second mold 220 (e.g., an up-down direction based on FIG. 1). The second mold 220 may be provided to be movable in directions in which the second mold 220 moves toward and away from the first mold 210 (e.g., the up-down direction based on FIG. 1).

Figure 2:
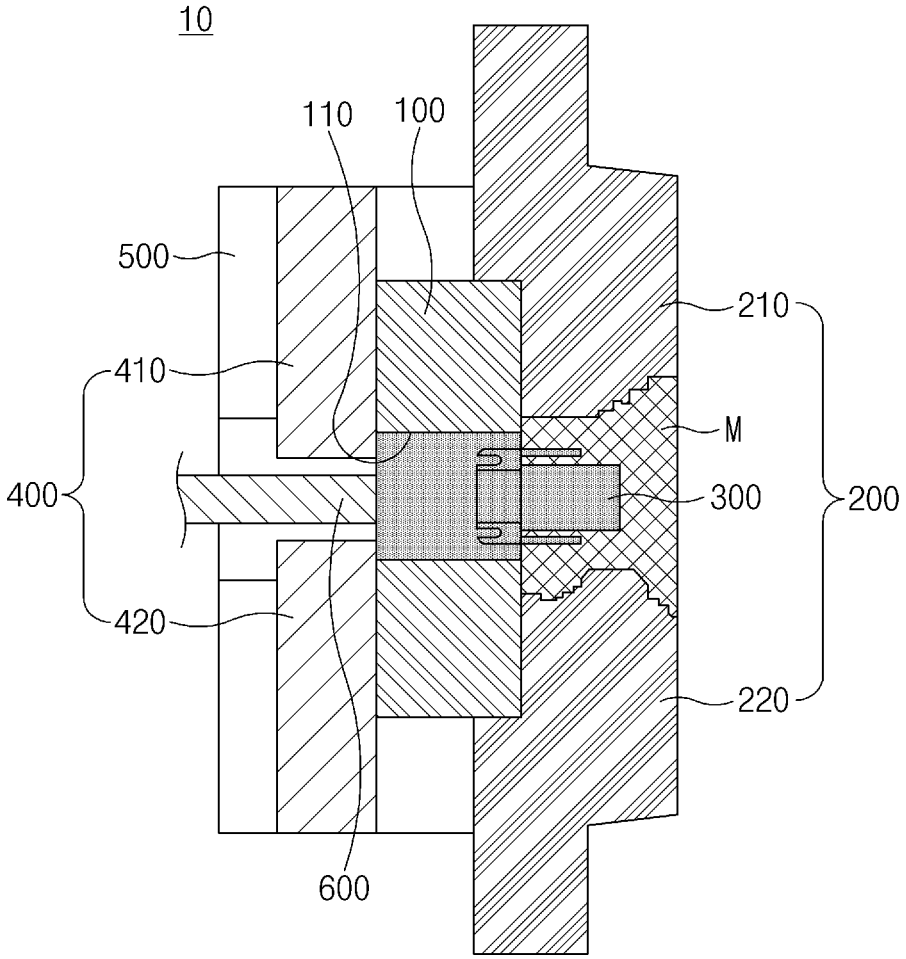
FIG. 2 shows a process of forming a molded body in the casting apparatus according to the present disclosure.

Referring to FIG. 2, in a state in which the first mold 210 and the second mold 220 are moved to be adjacent to each other (a state in which the first mold is moved downward and the second mold is moved upward based on FIG. 1), the molten metal may be injected into the cavity 201.

Figure 3:
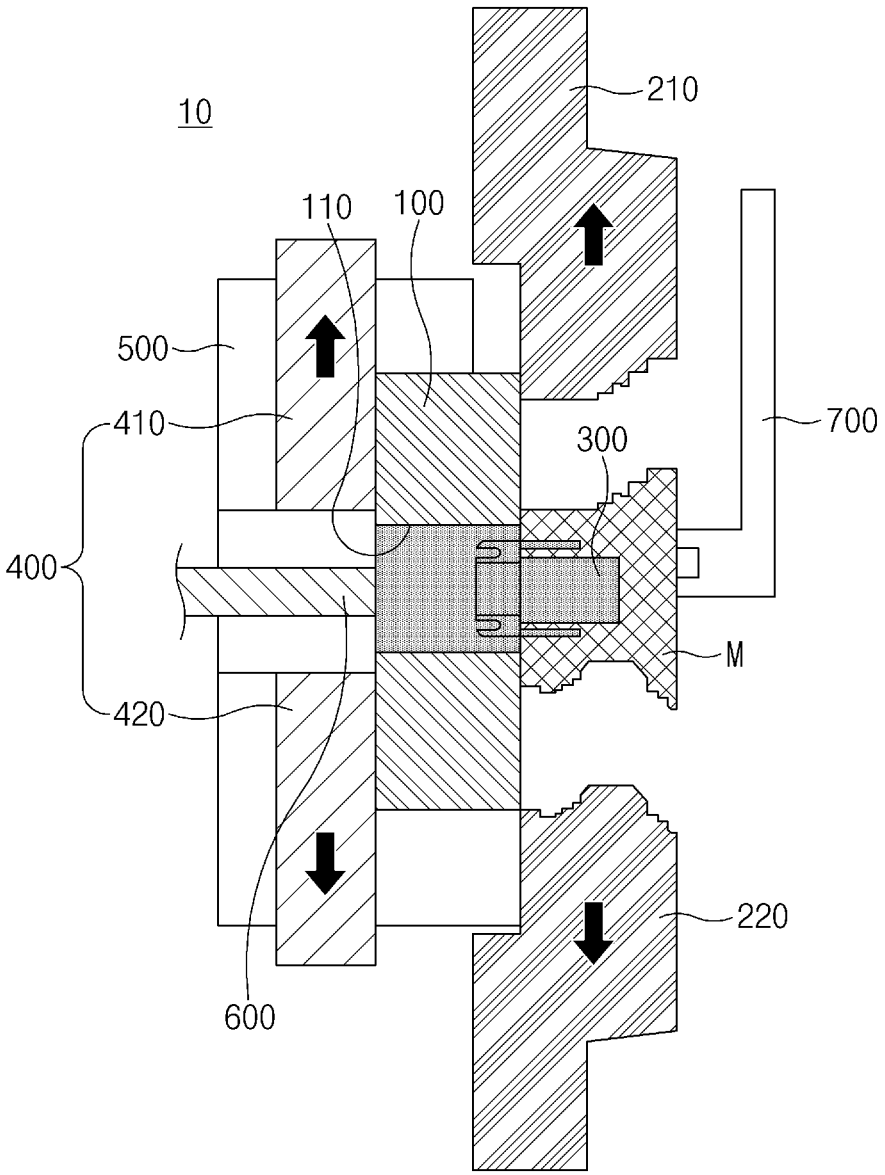
FIG. 3 shows a process of separating a die from a molded body in the casting apparatus according to the present disclosure.

In contrast, referring to FIG. 3, when the first mold 210 and the second mold 220 move away from each other (the first mold moves upward and the second mold moves downward based on FIG. 3) after the molded body M is completely manufactured in the cavity 201, the molded body M formed in the cavity 201 may be separated from the first mold 210 and the second mold 220.

The rectilinear movements of the first mold 210 and the second mold 220 may be performed by various well-known drive means. As an example, the first mold 210 and the second mold 220 may be configured to rectilinearly move toward and away from each other by a typical air cylinder.

According to another exemplary embodiment of the present disclosure, permanent magnets (not illustrated) having an N-pole and an S-pole may be alternately disposed on a base member (not illustrated), coils may be mounted on the first mold and the second mold, and an electric current to be applied to the coils is controlled, such that the first mold and the second mold may be rectilinearly moved relative to the base member on the principle of a linear motor. Alternatively, the first mold and the second mold may be rectilinearly moved by a lead screw, which is rotated by driving power from a drive motor, or other typical linear motion systems.

The insert member 300 is provided to be movable relative to the support block 100 so as to selectively move to the first position at which the insert member 300 is received in the cavity 201 or the second position at which the insert member 300 is extracted out of the cavity 201.

The insert member 300 is provided to form a hollow core portion (e.g., a hollow groove or a hollow hole) in the molded body M, and the present disclosure is not restricted or limited by the shape and the structure of the insert member 300.

For reference, in the exemplary embodiment of the present disclosure, the configuration in which the insert member 300 is disposed at the first position may mean that at least a part of the insert member 300 is disposed in the molded body M. In addition, in the exemplary embodiment of the present disclosure, the configuration in which the insert member 300 is disposed in the second position may mean that the insert member 300 is disposed outside the molded body M.

As an example, a through hole 110 may be formed in the support block 100, and the insert member 300 may move from the first position to the second position along the through hole 110.

In particular, the through hole 110 is formed to have a cross section (e.g., a circular cross section) corresponding to a cross section of the insert member 300.

For example, the insert member 300 may be disposed at the first position by moving to the right (based on FIG. 1) along the through hole 110. On the contrary, the insert member 300 may be disposed at the second position by moving to the left (based on FIG. 4) along the through hole 110.

Figure 4:
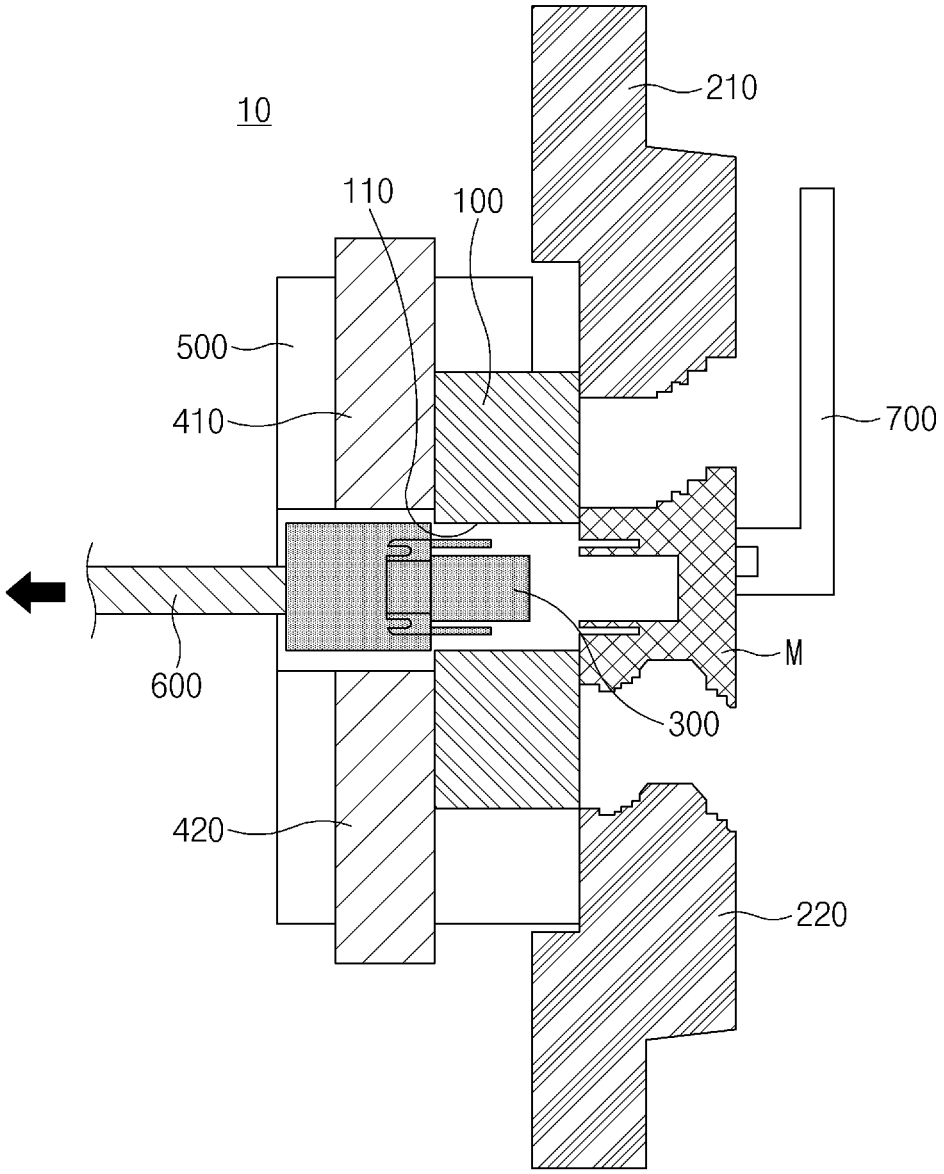
FIG. 4 shows a process of separating an insert member from a molded body in the casting apparatus according to the present disclosure.

According to the exemplary embodiment of the present disclosure, when the insert member 300 moves from the first position to the second position, the molded body M formed in the cavity 201 is supported by the support block 100, and the insert member 300 may be separated from the molded body M (see FIG. 4).

According to the exemplary embodiment of the present disclosure, the casting apparatus may include a restriction unit 400 that selectively restricts the insert member 300 disposed at the first position.

Since the restriction unit 400 is provided to selectively restrict the insert member 300 disposed at the first position as described above, it is possible to prevent the insert member 300 from being pushed rearward (to the left based on FIG. 2) by pressure of the molten metal injected into the cavity 201, and as a result, it is possible to improve stability and reliability, and more precisely manufacture the molded body M.

The restriction unit 400 may have various structures capable of restricting the insert member 300 disposed at the first position, and the present disclosure is not restricted or limited by the structure of the restriction unit 400.

As an example, referring to FIG. 2, the restriction unit 400 may include a first restriction block 410 provided on the other surface (a left surface based on FIG. 1) of the support block 100 and configured to move between a first closed position at which the first restriction block 410 closes the through hole 110 and a first opened position at which the first restriction block 410 opens the through hole 110, and a second restriction block 420 provided on the other surface (the left surface based on FIG. 1) of the support block 100 and configured to move between a second closed position at which the second restriction block 420 closes the through hole 110 and a second opened position at which the second restriction block 420 opens the through hole 110.

The first restriction block 410 may partially close one part of the through hole 110 at the first closed position, and the second restriction block 420 may partially close the other part of the through hole 110 at the second closed position.

More specifically, when the first restriction block 410 and the second restriction block 420 are disposed at the first closed position and the second closed position, respectively, a rear end (a left end based on FIG. 2) of the insert member 300 is restricted by the first restriction block 410 and the second restriction block 420, such that the movement of the insert member 300 may be prevented.

In particular, the first restriction block 410 and the second restriction block 420 may be symmetrically provided in a state in which the casting machine 600 connected to the insert member 300 is interposed between the first restriction block 410 and the second restriction block 420. More particularly, the first restriction block 410 and the second restriction block 420 may be configured to simultaneously move (e.g., the first restriction block moves from the first closed position to the first opened position and the second restriction block moves from the second closed position to the second opened position at the same time).

According to another exemplary embodiment of the present disclosure, the restriction unit may include only one restriction block or three or more restriction blocks, and the present disclosure is not restricted or limited by the number of restriction blocks and the structures of the restriction blocks that constitute the restriction unit.

According to the exemplary embodiment of the present disclosure, the casting apparatus may include a holder member 500 configured to support the first restriction block 410 and the second restriction block 420 such that the first restriction block 410 and the second restriction block 420 are movable.

The holder member 500 may have various structures capable of supporting the first restriction block 410 and the second restriction block 420 such that the first restriction block 410 and the second restriction block 420 are movable.

In this case, the movements of the first restriction block 410 and the second restriction block 420 relative to the holder member 500 may be implemented by a typical linear motion system such as a linear motor.

Since the holder member 500 is provided as described above, the movements and the arrangement states of the first restriction block 410 and the second restriction block 420 relative to the support block 100 may be stably supported, such that it is possible to obtain an advantageous effect of more stably maintaining the arrangement state of the insert member 300 and more precisely manufacturing the molded body M.

According to the exemplary embodiment of the present disclosure, the casting apparatus may include a transfer unit 700 configured to transfer the molded body M formed in the cavity 201. When the mold and the insert member 300 are separated from the molded body M in a state in which the transfer unit 700 holds the molded body M, the transfer unit 700 may transfer the molded body M to a predetermined ejected position.

The transfer unit 700 may have various structures capable of holding and transferring the molded body M, and the present disclosure is not restricted or limited by the holding structure and the transfer structure of the transfer unit 700.

As an example, the transfer unit 700 may hold the molded body M in a vacuum suction manner or may hold the molded body M by grasping an edge of the molded body M. In addition, the transfer unit 700 may transfer the molded body M while rectilinearly moving along an X-axis, a Y-axis, and a Z-axis or may transfer the molded body M while being moved by a multi-axis robot.

According to the exemplary embodiment of the present disclosure, the casting machine 600 may be connected to a rear side of the insert member 300 in order to inject molten metal into the cavity 201 and apply pressure.

In particular, the insert member 300 may be configured to be moved between the first position and the second position by the casting machine 600.

A typical casting machine 600 capable of injecting molten metal into the cavity 201 and applying pressure by using air pressure, water pressure, oil pressure, and the like may be used as the casting machine 600, and the present disclosure is not restricted or limited by the type and the structure of the casting machine 600.

Hereinafter, a casting method according to the exemplary embodiment of the present disclosure will be described. Further, the parts identical and equivalent to the parts in the above-mentioned configuration will be designated by the identical or equivalent reference numerals, and detailed descriptions thereof will be omitted.

The casting method according to the exemplary embodiment of the present disclosure includes disposing the insert member 300 in the cavity 201 provided in the die 200, forming the molded body M by injecting molten metal into the cavity 201, separating the die 200 from the molded body M, separating the insert member 300 from the molded body M by moving the insert member 300 out of the cavity 201, and transferring the molded body M to a predetermined ejected position.

First, the insert member 300 is disposed in the cavity 201 provided in the die 200.

Referring to FIG. 1, the insert member 300 is disposed in the cavity 201 (at the first position) in the state in which the first mold 210 and the second mold 220 of the die 200 are moved to be adjacent to each other.

In particular, the die 200 is provided on one surface of the support block 100 and forms the cavity 201 in cooperation with the support block 100.

Next, the molded body M is formed by injecting the molten metal into the cavity 201.

Referring to FIG. 2, the molded body M may be formed in the cavity 201 by injecting the molten metal into the cavity 201 and applying pressure.

Next, when the molded body M is completely manufactured, the die 200 is separated from the molded body M.

Referring to FIG. 3, when the molded body M is completely manufactured in the cavity 201, the first mold 210 and the second mold 220 are moved away from each other, such that the molded body M formed in the cavity 201 may be separated from the first mold 210 and the second mold 220.

Next, the insert member 300 is separated from the molded body M by moving the insert member 300 out of the cavity 201.

Referring to FIG. 4, when the insert member 300 is moved from the first position to the second position, the insert member 300 may be separated from the molded body M in the state in which the molded body M is supported by the support block 100.

For reference, the movement of the insert member 300 (the movement from the first position to the second position) may be allowed by moving in advance the first restriction block 410 and the second restriction block 420 to the first opened position and the second opened position, respectively, before separating the insert member 300 from the molded body M.

In particular, a part of the molded body M may be supported by the support block 100 while the insert member 300 moves to the second position, and the insert member 300 may be separated from the molded body M by being moved rearward (to the left based on FIG. 4) from the molded body M.

Figure 5:
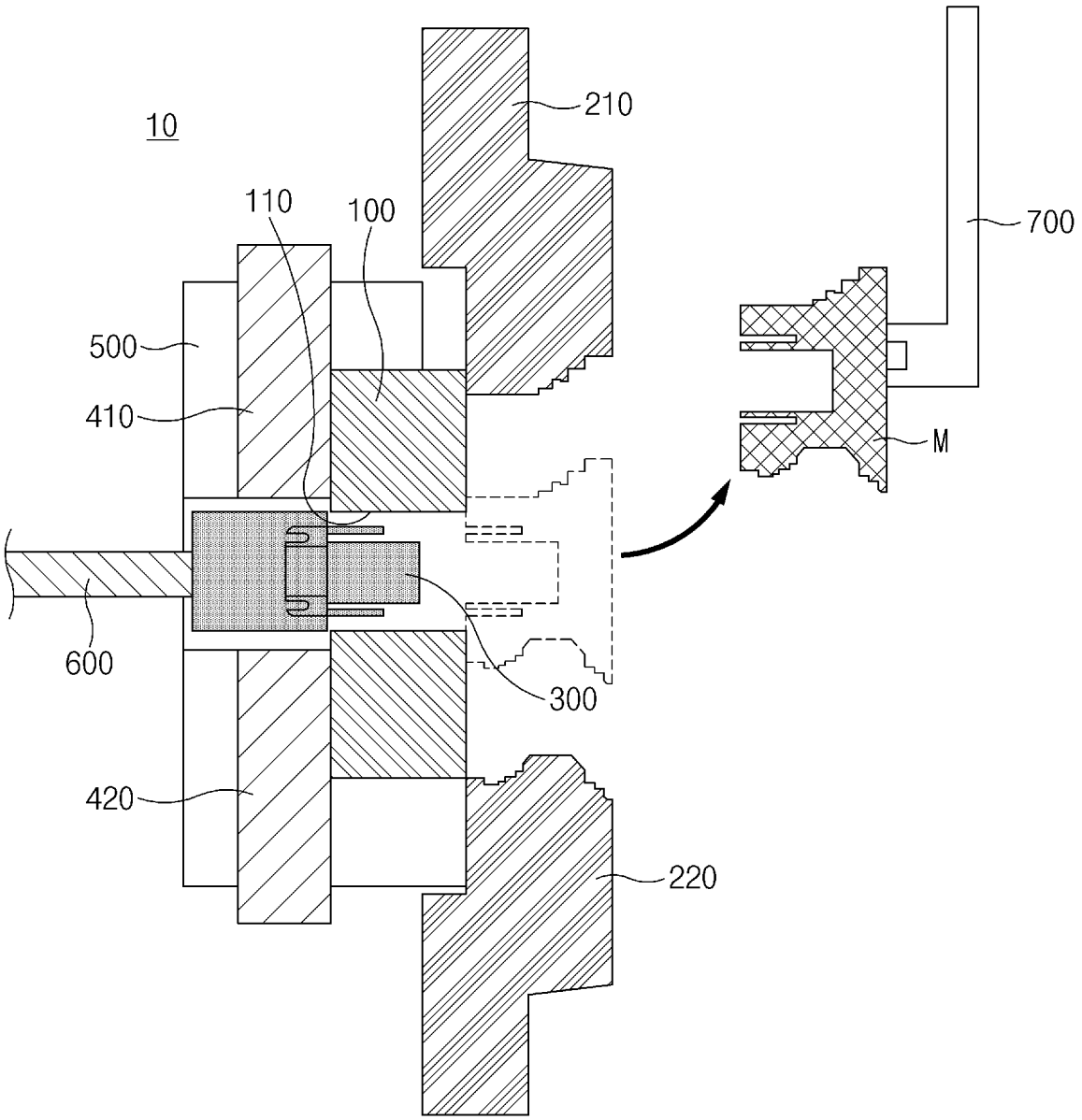
FIG. 5 shows a process of transferring a molded body in the casting apparatus according to the present disclosure.

Thereafter, as illustrated in FIG. 5, the molded body M separated from the die 200 and the insert member 300 is transferred to the predetermined ejected position, such that the process of manufacturing the molded body M may be completed.

According to the present disclosure as described above, it is possible to obtain an advantageous effect of simplifying the structure and the manufacturing process.

In particular, according to the exemplary embodiment of the present disclosure, the molded body may be extracted from the die without using an ejector pin, and as a result, it is possible to obtain an advantageous effect of simplifying the structure and the manufacturing process of the casting apparatus.

In addition, according to the exemplary embodiment of the present disclosure, it is possible to obtain an advantageous effect of reducing manufacturing costs and decreasing maintenance and repair costs.

In addition, according to the exemplary embodiment of the present disclosure, it is possible to obtain an advantageous effect of reducing the time taken to manufacture the molded body and improving production efficiency.

While the exemplary embodiments have been described above, but the exemplary embodiments are just illustrative and not intended to limit the present disclosure. It can be appreciated by those skilled in the art that various modifications and alterations, which are not described above, may be made to the present exemplary embodiment without departing from the intrinsic features of the present exemplary embodiment. For example, the respective constituent elements specifically described in the exemplary embodiments may be modified and then carried out. Further, it should be interpreted that the differences related to the modifications and alterations are included in the scope of the present disclosure defined by the appended claims.

The invention claimed is:

1. A casting method using a casting apparatus, the casting apparatus comprising:

a support block having a through hole;

a die provided on a first surface of the support block, the die being configured to form a cavity in cooperation with the support block; and an insert member movable relative to the support block and configured to selectively move between a first position at which the insert member is received in the cavity and a second position at which the insert member is extracted out of the cavity;

a restriction unit configured to selectively restrict the insert member disposed at the first position, wherein the restriction unit comprises a first restriction block provided on a second surface of the support block and configured to move between a first closed position at which the first restriction block closes the through hole and a first opened position at which the first restriction block opens the through hole, and a second restriction block provided on the second surface of the support block and configured to move between a second closed position at which the second restriction block closes the through hole and a second opened position at which the second restriction block opens the through hole; and a holder member configured to support the first restriction block and the second restriction block such that the first restriction block and the second restriction block are movable;

wherein the insert member moves from the first position to the second position along the through hole;

the casting method comprising:

disposing the insert member in the cavity provided in the die;

forming a molded body by injecting molten metal into the cavity;

separating the die from the molded body;

moving the first restriction block and the second restriction block from the holder member to open the through hole;

separating the insert member from the molded body by moving the insert member out of the cavity; and transferring the molded body to a predetermined ejected position.

2. The casting method of claim 1, wherein in the separating of the insert member from the molded body by moving the insert member out of the cavity, the molded body is supported by the support block, and the insert member is moved and separated from the molded body.

* * * * *